United States Patent [19]

Goelz

[11] 4,274,512

[45] Jun. 23, 1981

[54] ROVING BRAKE

[75] Inventor: David W. Goelz, Burbank, Calif.

[73] Assignee: Poly-Glas Systems, Sun Valley, Calif.

[21] Appl. No.: 7,074

[22] Filed: Jan. 29, 1979

Related U.S. Application Data

[63] Continuation-in-part of Ser. No. 871,284, Jan. 23, 1978, abandoned.

[51] Int. Cl.[3] ..... B65H 59/10

[52] U.S. Cl. ..... 188/65.1; 242/149

[58] Field of Search ..... 188/65.1, 65.2, 67, 188/83; 242/147 R, 149, 156, 156.1; 66/146; 87/56; 139/216

[56] References Cited

U.S. PATENT DOCUMENTS

| | | | |
|---|---|---|---|
| 733,299 | 7/1903 | Sui | 242/149 |
| 975,051 | 11/1910 | Palme | 139/216 |
| 1,672,471 | 6/1928 | Peterson | 242/149 |
| 1,729,524 | 9/1929 | Sergeson | 139/216 |
| 2,068,330 | 1/1937 | Jessup | 188/65.1 |
| 3,489,250 | 1/1970 | Kulxmann | 188/83 |
| 3,595,498 | 7/1971 | Mackie | 242/149 |
| 3,777,856 | 12/1973 | Gardner et al. | 188/65.1 |

FOREIGN PATENT DOCUMENTS

| | | | |
|---|---|---|---|
| 2131302 | 12/1972 | Fed. Rep. of Germany | 242/149 |

*Primary Examiner*—Edward R. Kazenske

*Attorney, Agent, or Firm*—David O'Reilly; Donald M. Cislo

[57] ABSTRACT

A roving brake having a pair of flat-bladed leaf springs extending toward one another into engagement at their ends in a mutually opposed relationship to pinch roving or cordage passing between the leaf springs. The leaf springs are attached to a mounting bracket having a flange for securing the ends of the leaf springs in a separated relationship. The flange includes a guide means for guiding the roving between the abutting or pinching ends of the leaf springs. The bracket also has a parallel flange on the opposite end with an aperture for guiding the roving to prevent any binding. Posts attached to the bracket and abutting opposite sides of the leaf springs maintain the end of the leaf springs in a mutually biased relationship. The roving brake bracket may be mounted at any convenient location where delivery of roving to a cutter and spray gun is desired.

2 Claims, 5 Drawing Figures

ROVING BRAKE

This is a continuation-in-part of application Ser. No. 871,284, filed Jan. 23, 1978 now abandoned.

BACKGROUND OF THE INVENTION

This invention relates generally to braking systems for cordage and the like, and more particularly relates to a roving brake system Roving is a fiber glass multi-filament line similar to stranded cordage which is supplied to a cutter which cuts and sprays the fiber glass onto an article of manufacture simultaneously with resin and catalyst. The spray gun is usually adapted to simultaneously spray reactive components with a fiber glass by operation of the trigger on the spray gun. A cutter of this type is illustrated in U.S. Pat. No. 3,491,443, in which the roving is fed through a series of eyelets to the roving cutter for spraying on an article with a resin and catalyst.

A frequent problem with the roving delivery system is entangling and binding when the spray gun operator releases the trigger due to backlash and coasting of the roving. That is, the roving does not stop simultaneously with releasing of the trigger. To combat this, devices have been designed which maintain a constant tension on the roving delivered to the spraying apparatus. One such device is illustrated in U.S. Pat. No. 3,777,856. In the latter device the roving brake maintains tension on the roving and also acts to count the amount of roving being used. The device is, however, somewhat complex and expensive to manufacture. Another device which is considerably simpler consists of guides with a weight between the guides applying pressure on the roving. The latter device, while being helpful, does not assure proper alignment or prevent any tangling of loops which happen to pass through the guides.

SUMMARY OF THE INVENTION

The purpose of the present invention is to provide a simple, roving brake system which will maintain tension on the roving to prevent binding, looping or entangling from coasting or overrun.

The present invention is comprised of a bracket having a flange with a pair of leaf springs mounted on opposite sides of the flange extending toward one another with their ends engaging in a mutually abutting relationship. A roving guide is also attached to the flange for guiding the roving between the engaged ends of the leaf springs. Means are provided on the flange for biasing the ends of the leaf spring into engagement to maintain their tension. The biasing means attached to the bracket may be adjustable to increase or decrease the amount of force or pinching and therefore the tension of the roving. In addition, the leaf springs have bent flanges on the opposite ends which may be slidably secured to the edges of the flange for easy installation and removal. The bracket has a second flange parallel to the first with a guide hole for maintaining the roving in a properly aligned relationship with the leaf springs or brake shoes.

The present invention also allows the passing of rather large knots "creel" knots commonly used in the industry. These "creel" knots are tied from the end of one bobbin or spool of roving to another to eliminate rethreading of the roving when a spool runs out. In addition, the brake device of the present invention can be mounted in any position since it will function when mounted horizontally or vertically A distinct advantage of the roving brake disclosed herein is that the brake shoes or leaf springs may be readily removed and replaced in addition to the fact that the leaf springs tend to remove loops or knots in the roving. In addition, the pinching action tends to smooth out the strands of the roving for delivery to the roving cutter.

It is one object of the present invention to provide a roving brake which is simple in construction for maintaining the tension of roving.

Another object of the present invention is to provide a roving brake having brake members or shoes which are readily removable and replaced.

Still another object of the present invention is to provide a roving brake which is simple in construction and has an adjustable tension or pinching action.

Yet another object of the present invention is to provide a brake which will pass large knots to eliminate rethreading of roving.

Still another object of the present invention is to provide a roving brake which will function regardless of the mounting position.

Other objects, advantages and novel features of the invention may become apparent from the following detailed description of the invention when considered in conjunction with the accompanying drawings wherein like reference numbers identify like parts throughout.

DETAILED DESCRIPTION OF THE PREFERRED EMBODIMENT

Figure 1:
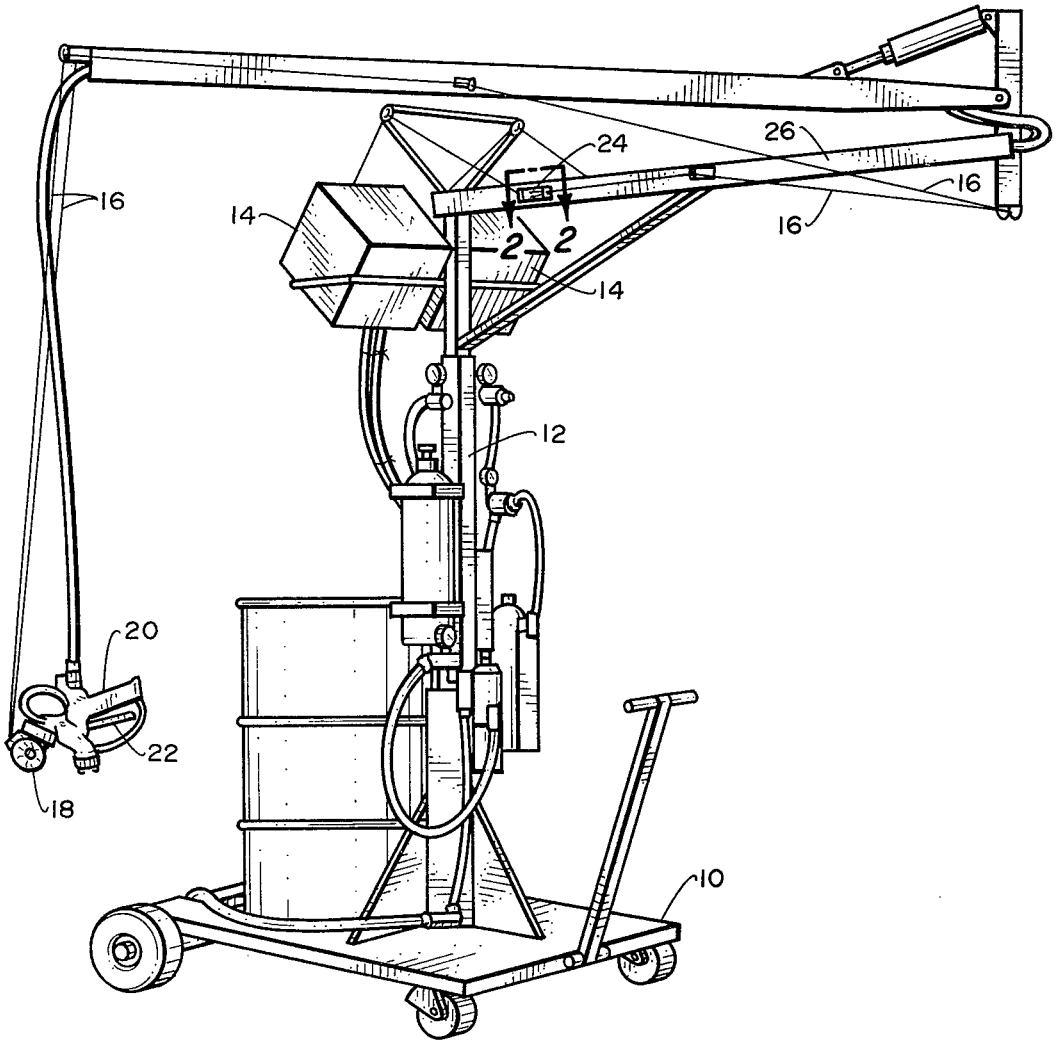
FIG. 1 illustrates a boom arrangement having a roving delivery system for use with the roving brake of the invention.
Figure 3:
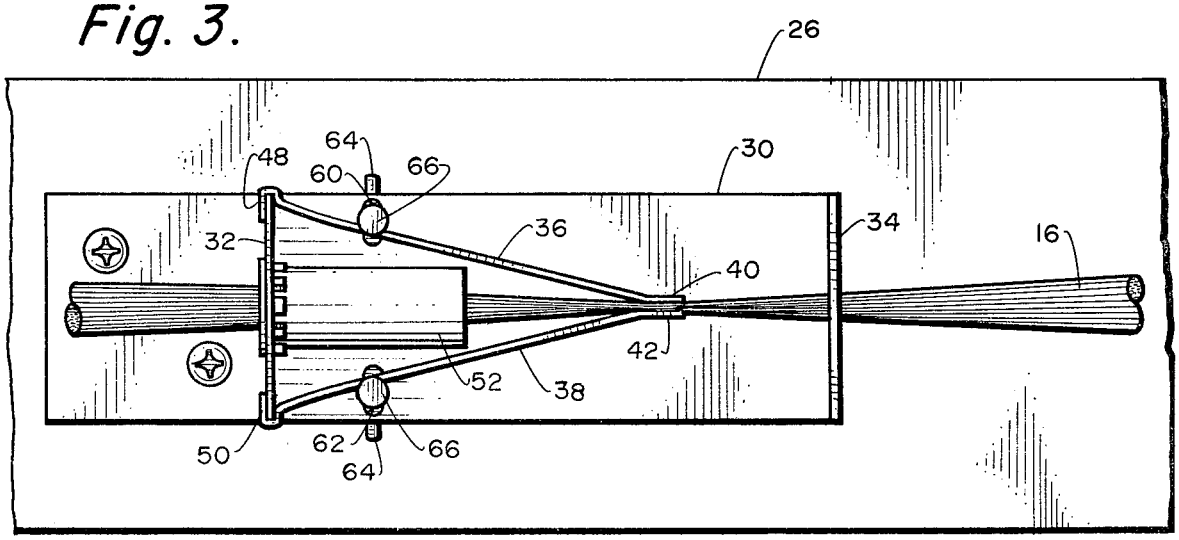
FIG. 3 is a view of the roving brake taken at 3—3 of FIG. 2

Referring to FIG. 1, which illustrates a typical system employing stranded fiber glass or roving; the system is comprised of a cart 10 having a boom 12 on which are mounted containers 14 having rolled coils of roving 16 for delivery to the cutter 18 of a spray gun 20. The roving 16 is automatically delivered to the cutter 18 by operation of the trigger 22 of the spray gun. The roving 16 is pulled from the storage containers 14 by the rotary motion of the cutter 18. Upon release of trigger 22, the roving delivery system should, preferably, stop instantly to prevent entanglement of the roving. Such tangles or binding of the roving causes a loss of time to untangle or unravel the roving before the system can be operated again. For that reason roving brake 24 would be mounted to maintain the tension on the roving during delivery to the cutter 18 on the spray gun 20.

Figure 2:
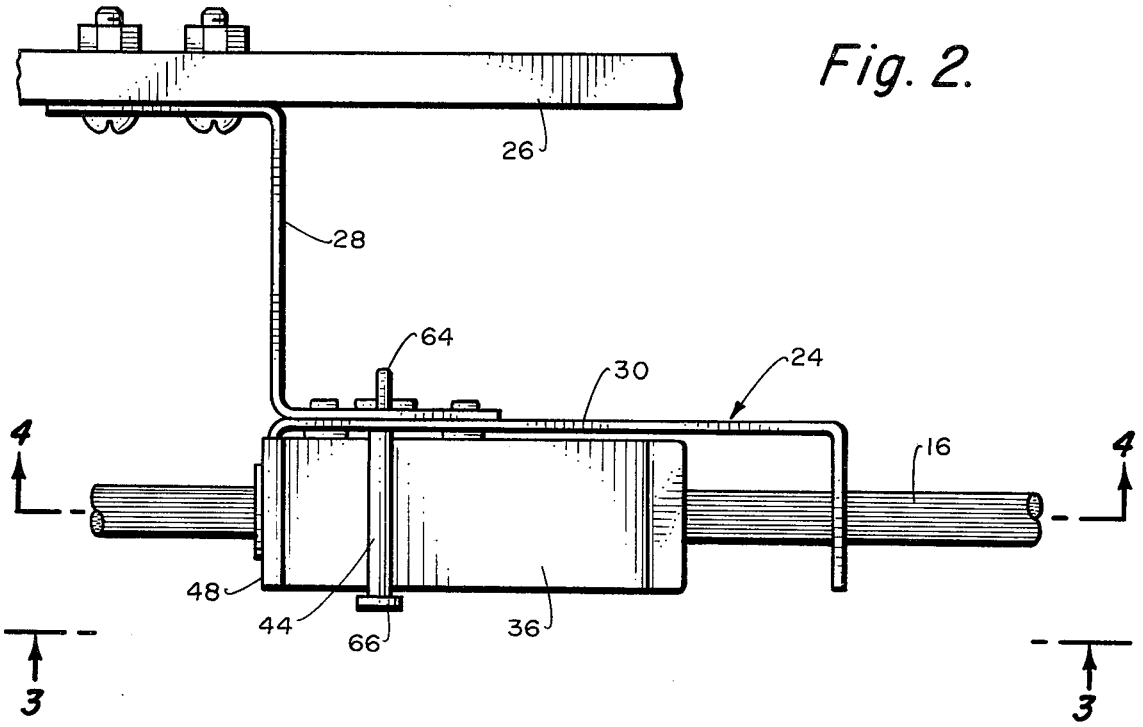
FIG. 2 is a view of the roving brake taken at 2—2 of FIG. 1.
Figure 4:
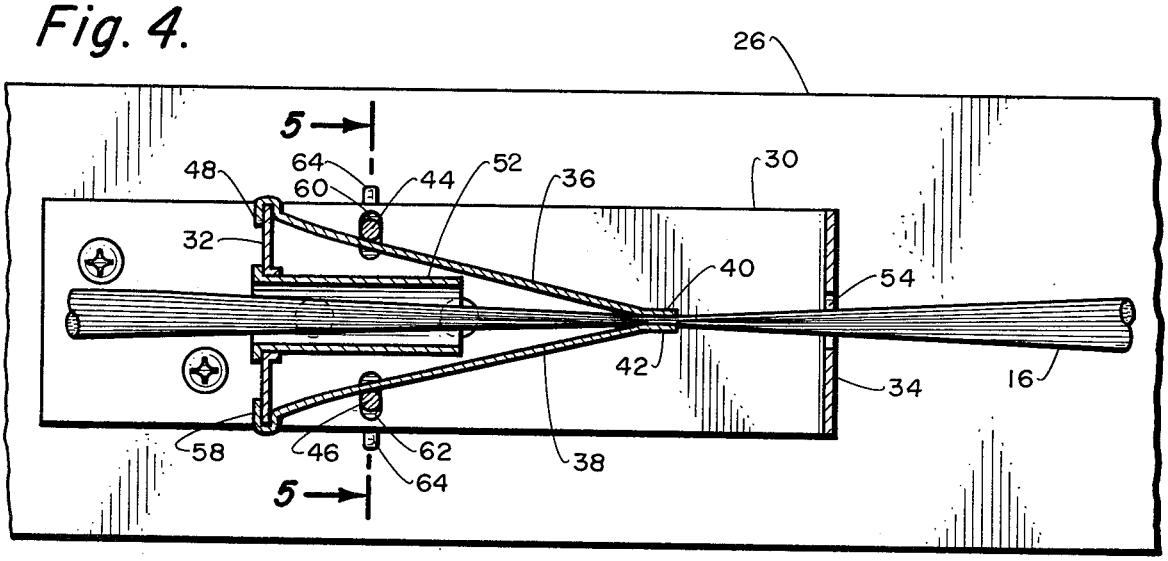
FIG. 4 is a sectional view of the roving brake taken at 4—4 of FIG. 2.
Figure 5:
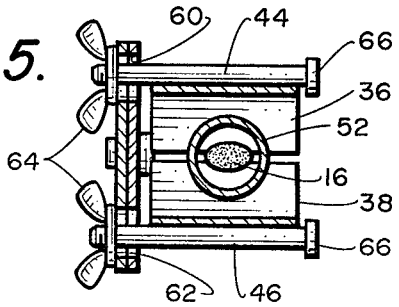
FIG. 5 is a sectional view of the roving brake taken at 5—5 of FIG. 4.

The roving brake of the present invention is illustrated in greater detail in FIG. 2 in which 26 indicates the arm of the boom 12 to which the roving brake 24 is attached by means of a bracket arm 28 attached to a bracket 30 for the brake shoes. The bracket 30 has flanges 32 and 34 extending outwardly in a parallel relationship for attachment of brake shoes or leaf springs 36 and 38 extending toward one another into abutting engagement at their ends 40 and 42.

Posts 44 and 46 are provided on the bracket 30 camming the outside surfaces of the leaf springs 36 and 38 to maintain their ends 40 and 42 in a mutually biased relationship. The opposite ends of the leaf springs 36, 38 have bent flanges 48 and 40 slidable over the edges of flange 32 to removably secure the leaf springs 36 and 38. Thus, when the leaf springs begin to wear, or lose their resiliency, they can readily be removed and replaced without the need for any tools. In order to maintain the roving 16 between the leaf springs 36 and 38, a guide 52 attached to the flange 32 is provided. The guide is preferably tubular in shape to assist in straightening out any loops or crimps in the roving 16 before it passes between the tips 40, 42 of the leaf springs. Also, to assist in smoothing out the roving 16, the tips 40 and 42 may be slightly flattened to provide broad, flat brake shoe surfaces pinching against the roving 16. A second flange 34 substantially parallel and identical with the first flange 32 is provided on the bracket 30 having an aperture 54 for assisting in guidance of the roving 16.

The roving brake, because of the biasing of shoes or springs 36, 38, can be mounted on the right, left, top or bottom of the boom 12 in any position. That is, it may be mounted horizontally or vertically or anywhere in between at any convenient location and will still function just as efficiently.

Further, the guide tube 52 and shoes 36, 38 will readily pass relatively large knots, permitting continuous feeding of roving without the tedious process of rethreading. It is common practice in the industry to tie the end of one bobbin or spool to another with a knot called a "creel" knot to eliminate rethreading when the first spool runs out. The guide tube and shoe of the roving brake disclosed herein permit these "creel" knots to easily pass.

Adjustment of the braking action of the leaf springs or shoes 36 and 38 can be by various means. It can be provided by bending the leaf springs toward each other, increasing the pinching action between ends 40 and 42, or it can be provided by making the posts 44 and 46 adjustable. For this purpose slots 60 and 62 in which posts 44 and 46 can be adjusted in or out are provided. To adjust the posts, wing nuts 64 would be provided for loosening the posts and moving them in, thus increasing the pinching or braking force on the ends 40 and 42. This may be beneficial when, after long periods of use, the resiliency of the leaf springs 36 and 38 begins to decrease. Since the leaf springs or shoes 36 and 38 are not permanently attached in any fashion, shoulders 66 may be provided on the ends of posts 44 and 46 to prevent the springs from slipping off during use.

In operation, the roving brake system would be attached to the arm 26 of the boom and the roving 16 passed through the guide 52 through the tips or shoe portions 40, 42 of the leaf springs 36, 38, and then through the aperture 54 in bracket flange 34. In the system illustrated in FIG. 1, there are dual roving supply spools on opposite sides of the boom 26 which means that a roving brake 24 would be mounted for each roving supply. As the trigger 22 is operated, withdrawing roving from the spool in the container 14, the roving passes through the guide tube 52, through the brake shoes 36, 38, providing a tension on the roving 16. In addition, loops or crimps in the roving 16 will be pulled out by the guide 52 and shoe ends 40, 42 of the brakes, smoothing but the roving for delivery to the cutter 18. When the trigger is released to stop spraying, the cutter 18 immediately stops. The leaf springs 36 and 38, by application of tension on the roving 16, immediately stop delivery of the roving, preventing any backlash or "coasting" causing entanglements.

After a period of time when the brake shoes or leaf springs 36 and 38 begin to lose their resiliency or the shoes 40, 42 show signs of wear, causing friction and possible damage to the roving 16, they can be easily replaced. This is accomplished by bending each spring slightly down around the shoulder 66 on the posts 44 and 46 and sliding the bent flange 48 or 58 off the edge of the flange 32. A new pair of leaf springs or shoes is easily replaced by reversing this procedure. The shoes 36 and 38 can likewise be removed to increase the tension by bending, if desired.

Thus, there has been disclosed a simple, easy-to-operate braking roving brake system having easily replaceable brake shoes which maintain a constant tension on roving delivered to a roving cutter. In addition, the device provides the additional advantage of removing loops or entanglements to straighten out the roving.

Obviously, many modifications and variations of the present invention are possible in light of the above teachings. It is therefore to be understood that the full scope of the invention is not limited to the details disclosed herein, but may be practiced otherwise than as specifically described.

What is claimed is:

1. A braking device for maintaining tension on roving comprising:

a U-shaped bracket having a base portion with first and second parallel flanges extending outwardly therefrom;

said first flange having parallel side edges;

mounting means for mounting said bracket to a surface such as a boom;

a pair of leaf springs located between said first and second flanges and respectively mounted on said side edges of said first flange, said pair of leaf springs extending toward one another with only a short portion at one terminal end of said leaf springs in mutually biased engagement;

said leaf springs each having a preformed flange on the other end thereof adapted to slidably engage the respective side edges of said first flange;

abutment means abutting an outer surface of each said spring for holding said one end of said springs in mutually biased relationship and said preformed flanges of said springs on said first flange;

each said abutment means comprising a post extending through an elongated slot in said base portion and being connected to said base portion, whereby the biasing force of said leaf springs may be varied by the positioning of said post in said slot; and roving guide means in said first flange for guiding roving between the mutually biased engaged ends of said leaf springs.

2. The braking device according to claim 1 wherein said roving guide means comprises;

a tubular guide means extending outward from said flange to near the mutually opposed ends of said leaf springs.

* * * * *